US007134153B2

(12) United States Patent
Kanthasamy

(10) Patent No.: US 7,134,153 B2
(45) Date of Patent: Nov. 14, 2006

(54) CRADLE CONVERSION SYSTEM

(75) Inventor: Abedan Kanthasamy, Subang Jaya (MY)

(73) Assignee: Lifestyle Solutions, Inc., Milipitas, CA (US)

( * ) Notice: Subject to any disclaimer, the term of this patent is extended or adjusted under 35 U.S.C. 154(b) by 0 days.

(21) Appl. No.: 10/940,404

(22) Filed: Sep. 14, 2004

(65) Prior Publication Data

US 2006/0053551 A1 Mar. 16, 2006

(51) Int. Cl.
*A47C 17/16* (2006.01)

(52) U.S. Cl. ..... 5/37.1; 5/41; 5/48

(58) Field of Classification Search ..... 5/37.1, 5/41, 47, 48
See application file for complete search history.

(56) References Cited

U.S. PATENT DOCUMENTS 4,642,823 A 2/1987 Wiggins
4,829,611 A 5/1989 Fireman et al.
4,875,244 A 10/1989 Tremblay
5,146,640 A 9/1992 Barton et al.
5,303,432 A * 4/1994 Fitts ..... 5/37.1
5,315,722 A * 5/1994 Djie ..... 5/37.1
5,327,591 A 7/1994 Fireman et al.
5,509,151 A 4/1996 Fireman et al.
5,513,398 A * 5/1996 Dodge ..... 5/37.1
5,664,268 A 9/1997 Stoler et al.
5,940,907 A 8/1999 Stoler et al.
5,956,785 A 9/1999 Fireman
6,108,833 A 8/2000 Grossman et al.
6,298,504 B1 10/2001 Fireman
6,427,261 B1 * 8/2002 Chadbourn ..... 5/18.1
6,785,919 B1 * 9/2004 Grossman et al. ..... 5/37.1

* cited by examiner

*Primary Examiner*—Michael Trettel
(74) *Attorney, Agent, or Firm*—Winstead Sechrest & Minick; Henry L. Ehrlich

(57) ABSTRACT

A cradle conversion system having a cradle moveable between at least one sofa position and a bed position. The system comprised of a cradle having a first and second deck and a locking mechanism for selectively securing the decks in a set angular position to one another.

8 Claims, 8 Drawing Sheets

CRADLE CONVERSION SYSTEM

FIELD OF THE INVENTION

The present invention relates in general to folding furniture and more specifically to furniture wherein the cradle may be easily moved between varying positions.

BACKGROUND

Furniture that is convertible between a sofa position to a bed position are well known in the art as sofa-beds and futons. These devices typically use some type of a pawl or dog which lockingly engages one part of a folding frame with a second part of a folding frame. Generally, these members require gravity to force the pawl or dog into a position which causes latching between the two parts of the folding frame. Additionally, the prior art convertible furniture require several movements of various parts to accomplish the transition from a sofa position to a bed position. Further, the prior art convertible furniture is limited to conversion from a single sofa position to a bed position. Additionally, these prior art convertible furniture require multiple movements by a user to perform the conversion. These movements can be very difficult for many people, in particular women and those of smaller physical stature.

It would be a benefit therefore to provide a cradle conversion system that facilitates converting a cradle between a sofa position and a bed position in a substantially single movement. It would be a still further benefit to provide a locking mechanism that maintains the cradle in a set angular position in sofa positions.

SUMMARY OF THE INVENTION

In view of the foregoing and other considerations, the present invention relates to a cradle that may be converted between a sofa and a bed.

Accordingly, a cradle conversion system is provided. The cradle conversion system comprises a frame having a vertical guide and a horizontal guide; a first deck having a first and a second arm, each arm forming an elongated slot proximate to an internal end thereof, the elongated slots each having a locked position and an unlocked position; a second deck having a first extension and a second extension, each extension having an internal end; a vertical guide projection functionally connected between the second deck and the vertical guide; a horizontal guide projection functionally connected between the second deck and the horizontal guide; a first pivotal member connecting the first arm with the first extension and a second pivotal member connecting the second arm with the second extension, wherein the first pivotal member is disposed within the elongated slot of the first extension and the second pivotal member is disposed within the elongated slot of the second extension, each of the pivotal members being moveable between the locked and unlocked positions of the elongated slots; and a first foot connected to the first extension and a second foot connected to the second extension, wherein when the pivotal members are in the locked position the first and second foot engage the arms locking the first and second decks in a set angular relationship to one another and wherein when the pivotal members are in the unlocked position the first and second foot are disengaged from the arms and the decks are not maintained in a set angular relationship.

A method of converting a cradle between positions is also provided, the method comprising the steps of providing a cradle having a first deck and a second deck; moveably connecting the cradle in a frame; engaging a locking mechanism to secure the first deck and the second deck in a sofa position wherein the first deck and the second deck are secured in a set angular relationship to one another of less than 180 degrees irregardless of the positioning of the cradle within the frame; and disengaging the locking mechanism and setting the cradle in the bed position wherein the angular relationship between the first and second deck is approximately 180 degrees.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
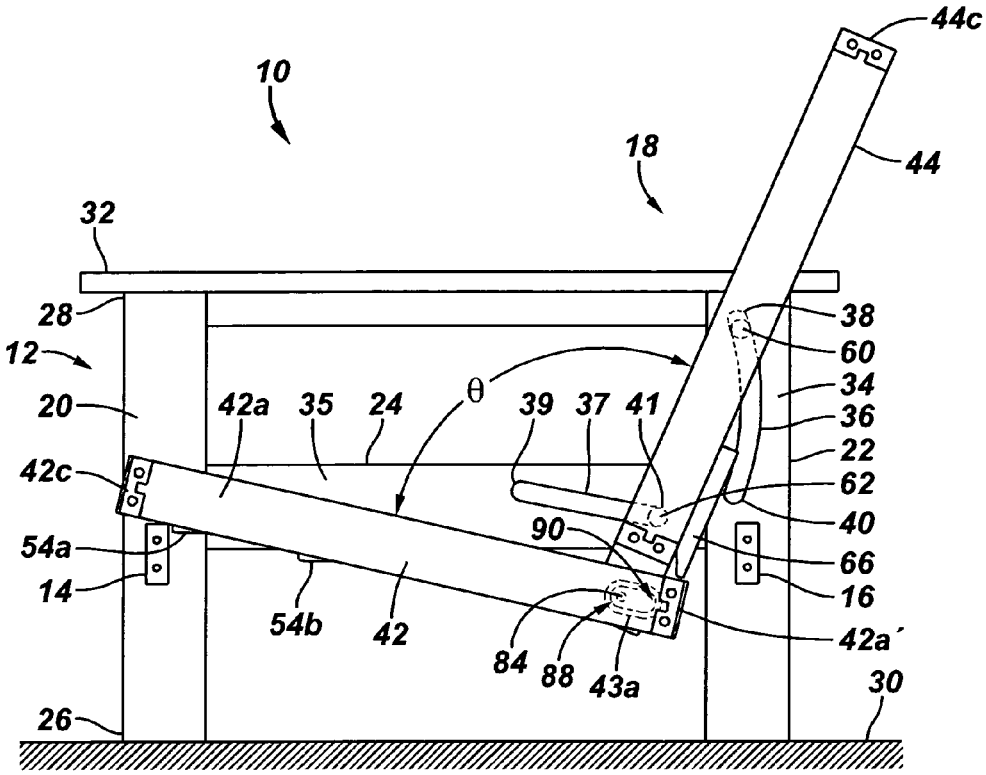
FIG. 1 is a side view of a cradle system of the present invention with the cradle in a sofa position.

Refer now to the drawings wherein depicted elements are not necessarily shown to scale and wherein like or similar elements are designated by the same reference numeral through the several views.

FIG. 1 is a side view of a cradle conversion system of the present invention, generally designated by the numeral 10, shown in a sofa position. Cradle system 10 includes a pair of side frames 12, stretcher rails 14 and 16, and a cradle generally designated by the numeral 18. Cradle 18 may be readily disposed in various positions.

FIG. 1 shows a single side frame 12. As is readily understood, cradle conversion system 10 includes two side frames 12. Side frames 12 are mirror images of one another. Each side frame 12 includes a first leg 20 and second leg 22 extending parallel to one another and spaced apart by a horizontal strut 24. Legs 20 and 24 each have a floor end 26 and top end 28. Legs 20 and 24 extend substantially vertical from a floor or ground surface 30. Side frame 12 may further include an arm rest 32 connected between legs 20 and 22 proximate to the top end 28 of each leg. The pair of side frames 12 are spaced apart by first and second stretcher rails 14 and 16.

Each second leg 22 has an interior face 34 that is directed toward the corresponding side frame 12 and cradle 18. Formed along interior face 34 is a vertical guide 36 positioned between the connection of second stretcher rail 16 and top end 28. Vertical guide 36 is illustrated as a groove formed in interior face 34 of second leg 22; however, guide 36 may include other guide mechanisms. Vertical guide 36 defines a path between a top position 38 and a bottom position 40. The path formed by vertical guide 36 may take various configurations. In the present embodiment, vertical guide 36 forms an arcurate path.

Each horizontal strut 24 has an interior face 35 that is directed toward the corresponding side frame 12 and cradle 18. Formed along interior face 35 is a horizontal guide 37 positioned between first leg 20 and second leg 22. Horizontal guide 37 is illustrated as a groove formed in interior face 35 of horizontal strut 24; however, horizontal guide 37 may include other guide mechanisms, such as a track. Horizontal guide 37 forms a path between a first end 39 oriented toward first leg 20 and a second end 41 oriented toward second leg 22. The path formed by horizontal guide 37 may take various configurations. In the present embodiment horizontal guide 35 defines a substantially linear path angled toward surface 30 from first end 39 to second end 41.

Side frames 12 are spaced apart by a pair of stretcher rails 14 and 16. Stretcher rails 14 and 16 are shown in more detail in FIG. 2. First stretcher rail 14 is connected between the first legs 20 of each side frame 12. Second stretcher rail 16 is connected between the second legs 22 of each side frame 12. When connected, side frames 12 and stretcher rails 14 and 16 form a substantially rectangular or square frame for cradle 18.

Figure 2:
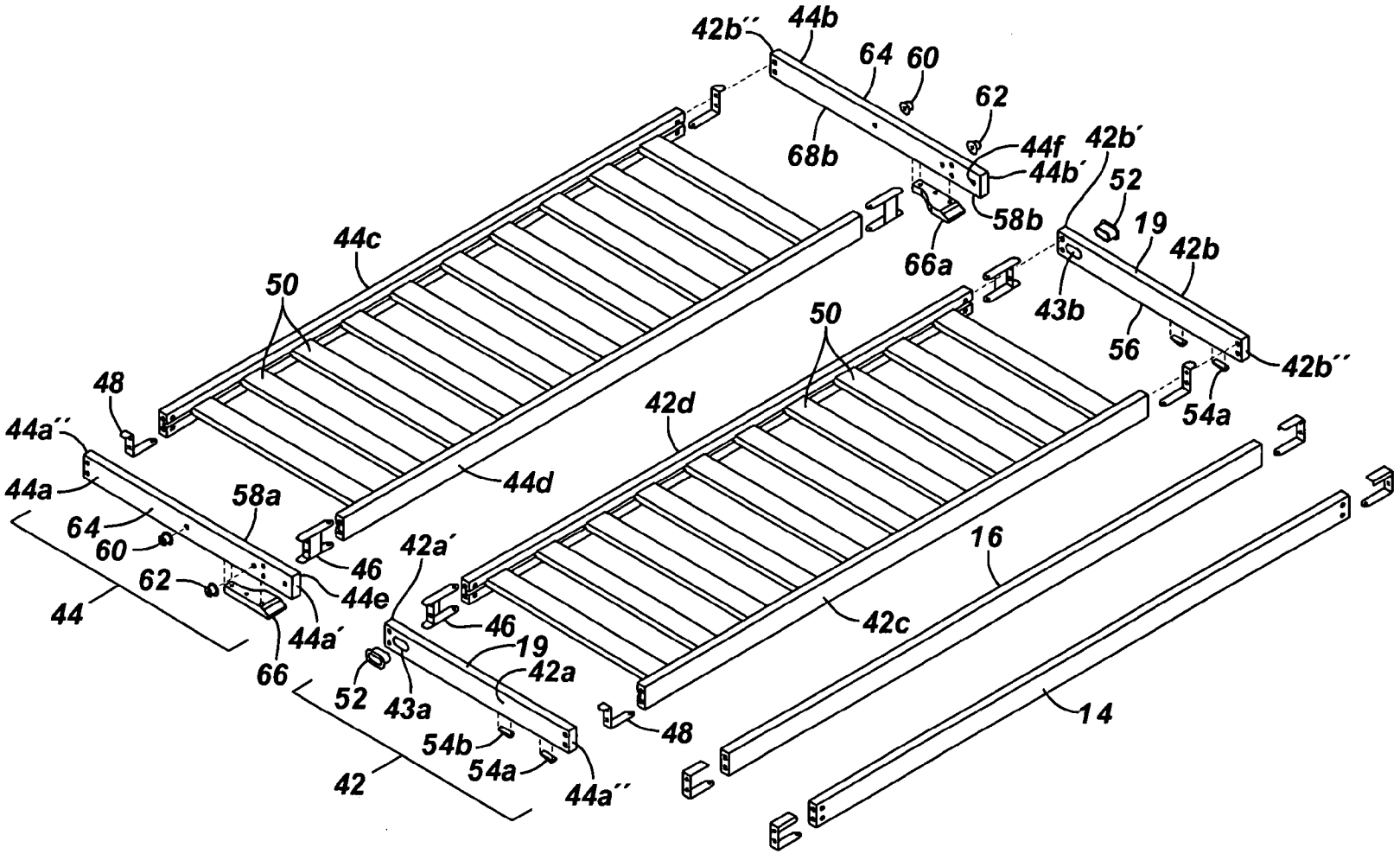
FIG. 2 is an exploded view of the cradle and the stretcher rails.

Refer now to FIG. 2, which illustrates an exploded view of cradle 18, including first and second stretcher rails 14 and 16. Cradle 18 includes a first deck 42 and a second deck 44.

First deck 42 includes a first arm 42*a* having an internal end 42*a*' and a terminal end 42*a*" and a second arm 42*b* having an internal end 42*b*' and an terminal end 42*b*'". An internal cross-member 42*d* is connected to terminal ends 42*a*' and 42*b*' by H-brackets 46. An external cross-member 42*c* is connected to the terminal ends 42*a*" and 42*b*" by a Z-bracket 48. Slats 50 are spaced and connected between external cross-member 42*c* and internal cross-member 42*d* to support a futon pad thereon.

Arm 42*a* forms an elongated slot 43*a*. Elongated slot 43*a* is formed proximate to internal end 42*a*' between external cross-member 42*d* and external cross-member 42*c*. Similarly, arm 42*b* forms an elongated slot 43*b*. Elongated slot 43*b* is formed proximate to internal end 42*b*' between cross-members 42*c* and 42*d*. A lining 52, such as a plastic grommet, may be placed within elongated slots 43.

First cradle 42 further includes stops 54. Stops 54 are connected to the back side 56 of arms 42*a* and 42*b*. A first stop 54*a* is shown closest to terminal end 42*a*" and 42*b*", and a second stop 54*b* spaced from and behind first stop 54*a*. Although two stops 54 are shown on each arm, more or fewer stops may be utilized.

Second deck 44 includes a first extension 44*a* having an internal end 44*a*' and a terminal end 44*a*", and a second extension 44*b* having an internal end 44*b*' and a terminal end 44*b*". An external cross-member 44*c* is connected between terminal ends 44*a*" and 44*b*" by Z-brackets 48. An internal cross-member 44*d* is connected between extensions 44*a* and 44*b*, a distance from internal end 44*a*' and 44*b*'. This distance from internal ends 44*a*' and 44*b*' defines a leg 58*a* and 58*b* respectively. Slats 50 are spaced and connected between external cross-member 44*c* and internal cross-member 44*d* to support a futon pad thereon.

Extensions 44*a* forms a hole 44*e* therethrough. Hole 44*e* is formed through leg portion 58*a* of extension 44*a*. Similarly, leg portion 58*b* of extension 44*b* forms a hole 44*f* there through. When cradle 18 is constructed, hole 44*e* is aligned with elongated slot 43*a* and hole 44*f* is aligned with elongated slot 43*b*.

Second deck 44 further includes a pair of guide projections extending from each extension 44*a* and 44*b*. The projections may be rollers to further facilitate movement. The pair of guide projections includes a vertical guide projection 60 and a horizontal guide projection 62. Projections 60 and 62 extend outwardly from the outer surface 64*a* of second deck extension 44*a*. Similarly, projections 60 and 62 extend outwardly from the outer surface 64*b* of second deck extension 44*b*. Each vertical projection 60 is adapted to be disposed in and travel within a vertical guide 36 (FIG. 1) of a side frame 12. Each horizontal projection 62 is adapted to be disposed in and travel within a horizontal guide 37 of a side frame 12.

Cradle 18 further includes a locking mechanism for: (i) selectively maintaining first deck 42 and second deck 44 in a fixed angular relationship to one another when cradle 18 is in the sofa or couch position; and (ii) for facilitating the movement of cradle 18 between a sofa and bed position in one movement not possible heretofore. The locking mechanism includes a lifting member or foot 66. A foot 66 is connected to the back side 68*a* of extension 44*a*, and another foot 66*a* is connected to the back side 68*b* of extension 44*b*.

Figure 3:
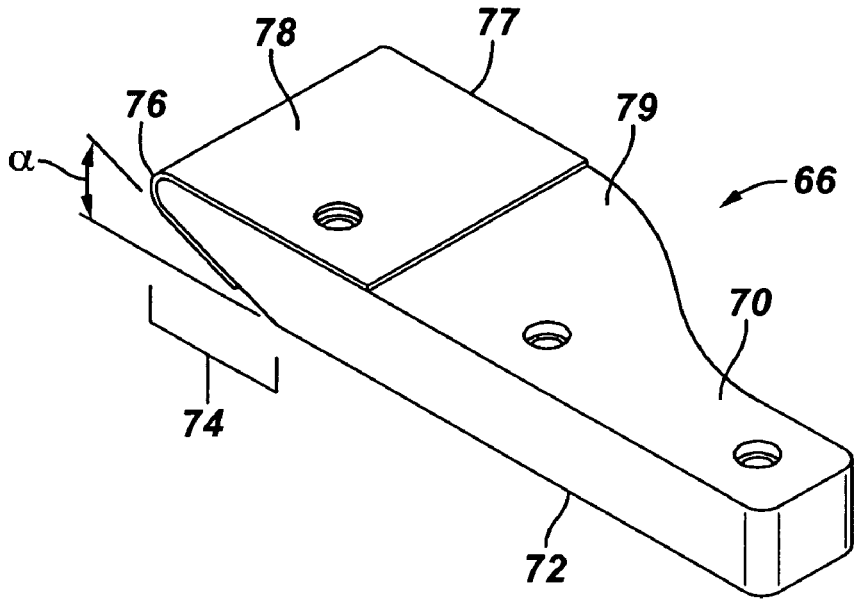
FIG. 3 is a perspective view of a foot in isolation.

Foot 66 is described in further detail in FIG. 3. FIG. 3 is a perspective view of foot 66 in isolation. Foot 66 includes a body 70 constructed of a substantially rigid material such as, but not limited to, wood or rubber. Foot 66 includes an elongated substantially linear cradle surface 72 for contacting the second deck extension to which it is to be connected. Foot 66 further includes a toe section 74. Toe section 74 is formed by angling cradle surface 72 to a toe end 76. The surface forms an acute angle, identified as a (alpha), from the linear plane of cradle surface 72 to toe end 76. Foot 66 may further include a support 78 to strengthen and support foot 66. In the illustrated embodiment, support 78 is a metal member fitting the contour of toe section 74. Support 78 includes an extended section 77, extending along a portion of the outer surface 79 of foot 66, to provide additional strength when the decks are locked in angular relationship to one another.

Figure 4:
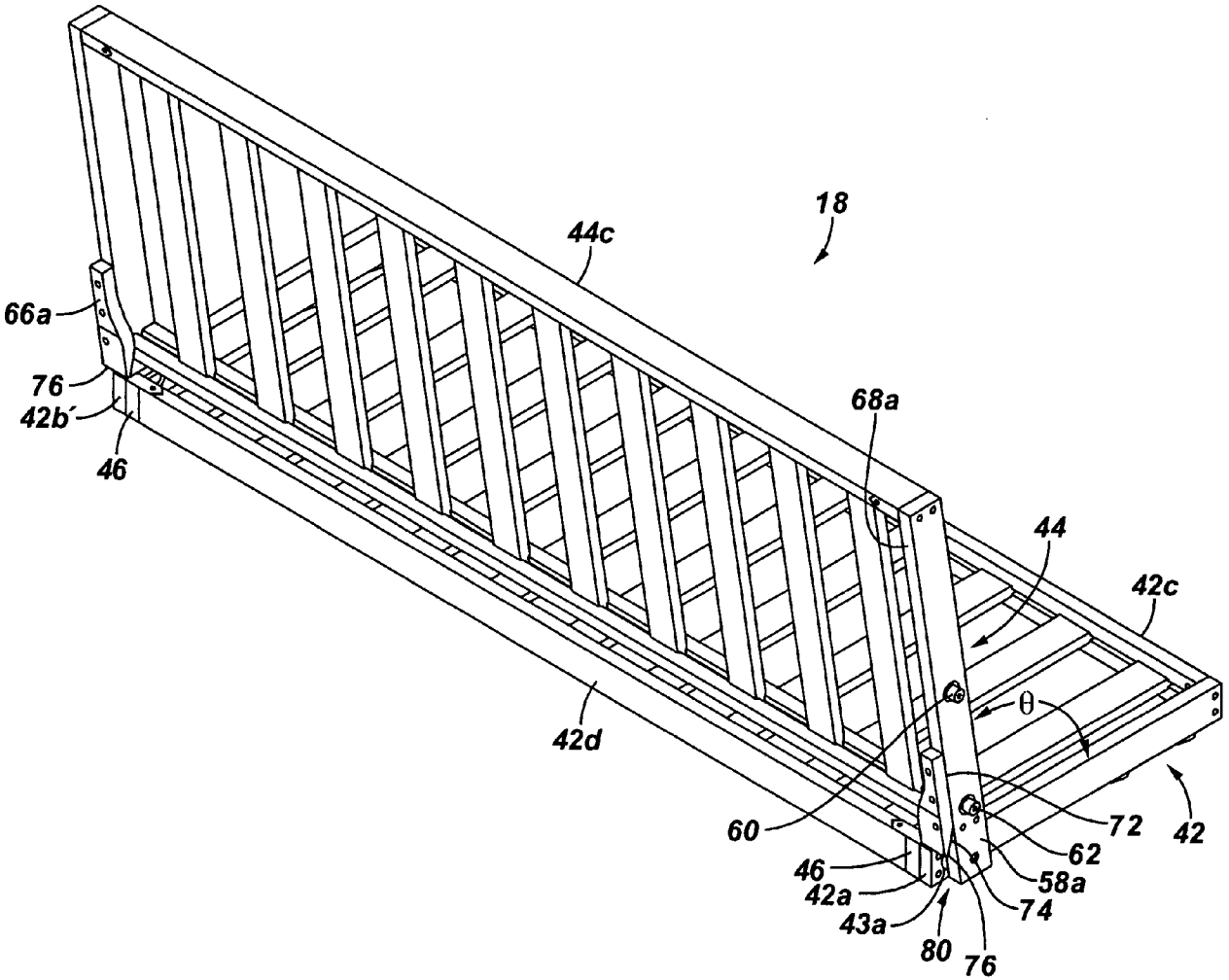
FIG. 4 is a perspective view of the cradle in isolation.

FIG. 4 is a perspective view of cradle 18 in isolation, configured in a sofa position. In this sofa configuration, first deck 42 serves as the seat and second deck 44 serves as the back. First deck 42 and second deck 44 are connected to one another by a pivot connection 80 which is further described and shown in relation to FIG. 5. It should be realized in the description of the invention, that pivot connection 80 provides hinged or pivotal movement and lateral movement of first deck 42 and second deck 44 in relation to one another. Pivot connection 80 is included in the locking mechanism of the present invention.

In FIG. 4, cradle 18 is locked in one of the sofa positions. Foot 66 is positioned so that toe end 76 contacts the upper side 19 of internal end 42*a*' and H-bracket 46. Similarly, the second foot 66*a* is positioned so that toe end 76 contacts internal end 42*b*' and an H-bracket 46. In this locked position, first deck 42 and second deck 44 are locked into a sofa position wherein decks 42 and 44 are maintained in a constant angular position. Angle θ illustrated in the present embodiment is approximately 100 degrees. It is desirable for seating angle θ to be established substantially at or between 90 and 105 degrees. The present invention provides a cradle 18 that may be moved between various sofa positions while maintaining a constant seating angle θ. In the prior art foldable furniture, the positioning of the cradle in various sofa positions resulted in various seating angles θ. The present invention allows a user to easily move the cradle into various sofa positions while maintaining a constant seating angle θ. As will be further described, feet 66 allow for single movement conversion of cradle 18 between the sofa and bed positions.

Figure 5:
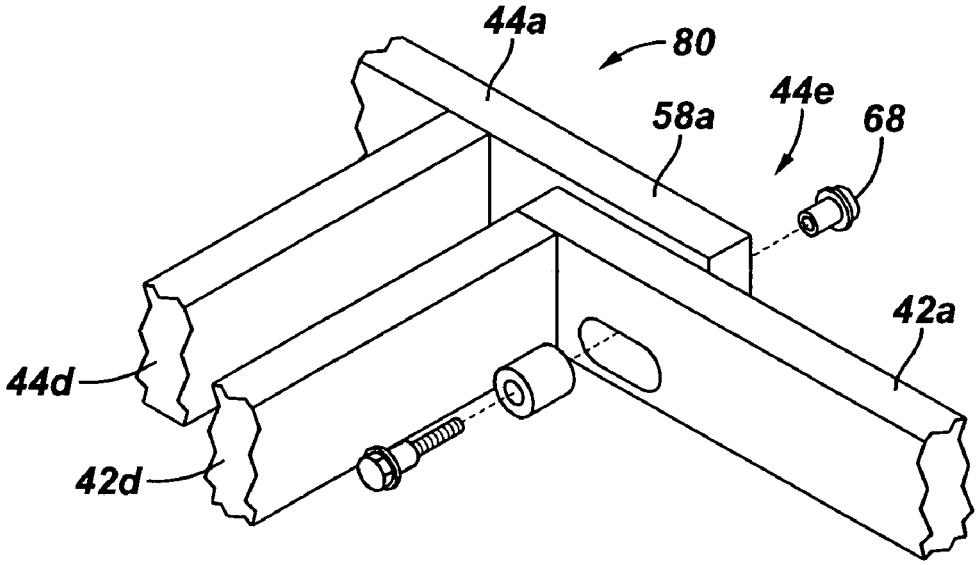
FIG. 5 is a partial cross-sectional view of the moveable interconnection of the first and second decks.

Refer now to FIG. 5, wherein a partial, exploded view of pivot connection 80 is shown. Note that pivot connection 80 is an element of the locking mechanism of the present invention. FIG. 5 shows the pivot connection 80 of the first and second decks 42 and 44 between extension 44*a* and arm 42*a*. Pivot connection 80 includes a bolt 82, roller 84 and a nut 86. Pivot connection 80 is accomplished by disposing roller 84 on bolt 82 and extending bolt 82 through hole 44*e*. With roller 84 disposed in elongated slot 43*a*, bolt 82 is secured with a nut 86. Roller 84 is moveable within elongated slot 43*a* from a locked position 88 to an unlocked position 90. Pivot connection 80 need not include a roller 84, although a roller 84 may be desirable. Therefore, for purposes of brevity hereafter "roller 84" includes only a bolt 82 or a bolt 82 and roller 84.

Referring back to FIG. 1, conversion system 10 is shown with cradle 18 in a locked sofa position. First deck 42 is positioned as the seat deck resting on first stretcher rail 14 with stop 54*a* contacting stretcher rail 14. Vertical projections 60 are positioned within vertical guides 36 proximate to top position 38. Horizontal guide projections 62 are positioned within horizontal guides 37 proximate to second end 41 of guides 37. Rollers 84 are positioned in elongated slot 43 proximate to locked position 88, and feet 66 are positioned wherein toe end 76 is in engaging contact with the internal ends of first deck arms 42*a* and 42*b*. In this locked sofa position, first deck 42 and second deck 44 are maintained in a set seating angle θ. Note that in this sofa position, first deck 42, serving as the seat deck, is angled in relation to surface 30. The angle of the seat deck in relation to surface 30 may be adjusted by the engagement of stops 54 with first stretcher rail 14.

Figure 6:
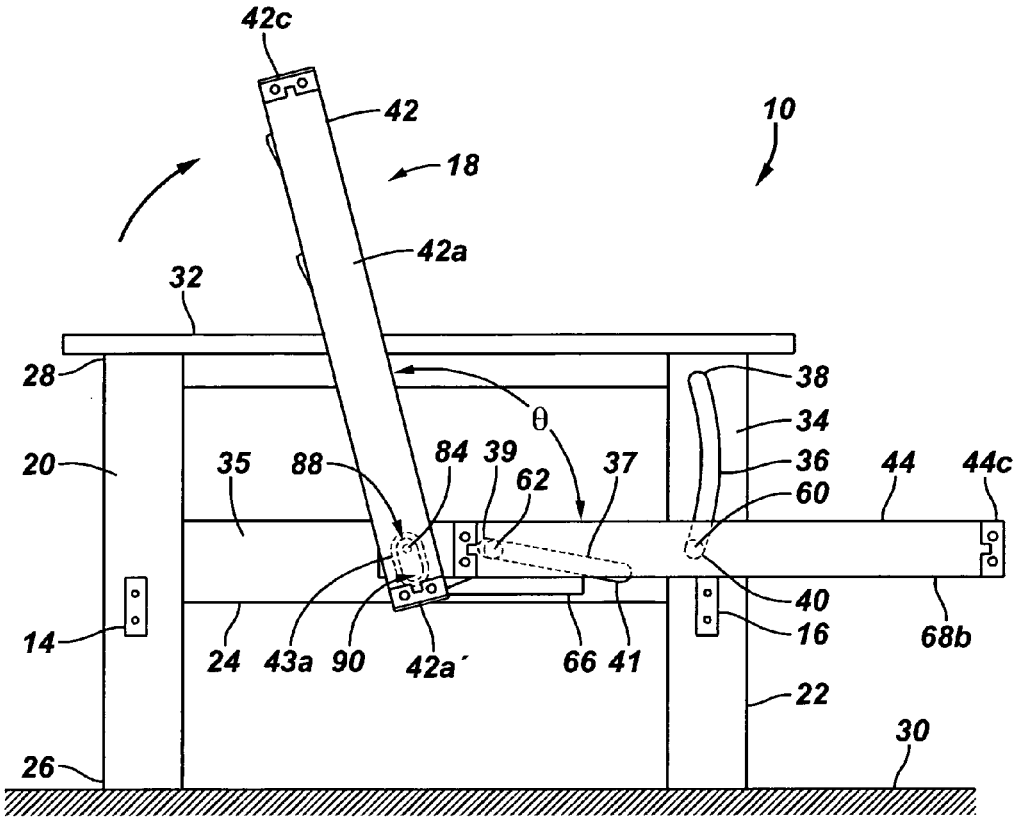
FIG. 6 is a side view of the cradle conversion system of the present invention with the cradle in another sofa position.

FIG. 6 is a side view of cradle system 10 showing cradle 18 in another position wherein cradle 18 is in a locked position. With additional reference to FIG. 1, first deck 42 has been raised and rotated in the direction indicated by the arrow so that first deck 42 serves as the back deck and second deck 44 serves as the seating deck. In this position, the angle θ of cradle 18 remains at the same angle as that in the sofa position shown in FIG. 1. Rollers 84 are positioned in elongated slots 43 proximate to the locked position 88. Horizontal guide projections 62 are positioned within horizontal guides 37 proximate to the first end 39 of guides 37. Vertical guide projections 60 are disposed proximate to the bottom position 40 of vertical guides 36. Second deck 44 rests atop second stretcher rail 16 substantially parallel to surface 30. The feet 66 are in engaging contact with the internal ends of the arms of first deck 42. This position is also an interim position in converting cradle 18 to the bed position.

Figure 7:
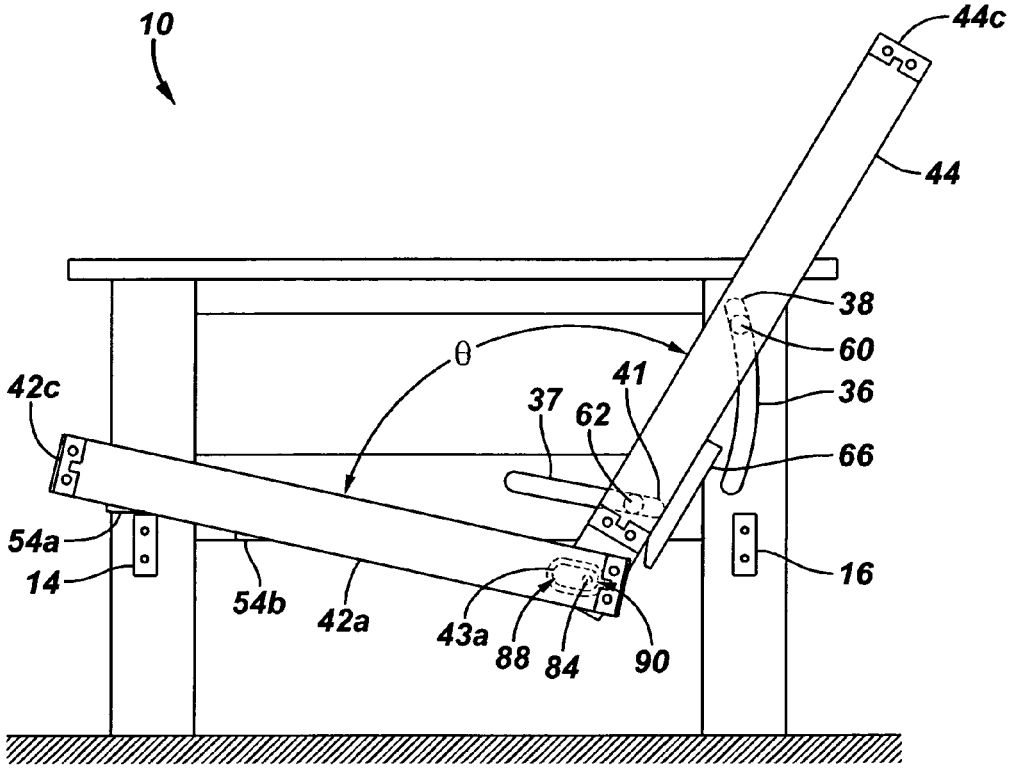
FIG. 7 is a side view of the cradle conversion system of the present invention in another sofa position.

FIG. 7 is a side view of cradle conversion system 10 in a relaxed sofa position. In the relaxed sofa position, the locking mechanism is in the unlocked position. Feet 66 are disengaged from contact with the internal ends of first deck 42, and rollers 84 are positioned proximate to the unlocked position 90 within elongated slots 43. First deck 42 is positioned as the seat deck and rests on first stretcher rail 14. A second stop 54*b* is in contact with first stretcher rail 14. Vertical guide projections 60 are positioned proximate to top position 38 of vertical guides 36. Horizontal guide projections 62 are positioned within horizontal guides 37 proximate to second end 41. In the relaxed sofa position, the seating angle θ is more obtuse than that in the locked sofa positions shown in FIGS. 1 and 6. For example, in the locked sofa position of FIGS. 1 and 6 the seating angle θ is approximately 100 degrees or less. In the relaxed sofa position of FIG. 7 the seating angle is approximately 109 degrees. It should also be recognized that the cradle 18 may be placed in the locked position, wherein feet 66 engage first deck 42, providing a more acute cradle angle.

With reference to FIGS. 1 through 7, cradle conversion system 10 of the present invention provides the ability to readily convert cradle 18 from one of multiple sofa positions into a bed position in essentially one motion, which is a feature or ability not provided heretofore. The bed position is defined by a seating angle θ of 180 degrees. In the bed position, first deck 42 rests atop first stretcher rail 14 and second deck 44 rests atop second stretcher rail 16; rollers 84 are positioned proximate to the unlocked position 90 in elongated slots 43; feet 66 are disconnected from engagement with first deck 44; horizontal guide projections 62 are positioned proximate to first end 39 of horizontal guides 37; and vertical guide projections 60 are positioned proximate to bottom position 40 of vertical guides 36.

A method of operating cradle system 10 is described with reference to FIGS. 1 through 9. FIGS. 8A through 8D illustrate converting cradle 18 from a first sofa position (FIG. 1) to the bed position. FIGS. 9A through 9D illustrate converting cradle 18 from the bed position to the first sofa position.

Figure 8A:
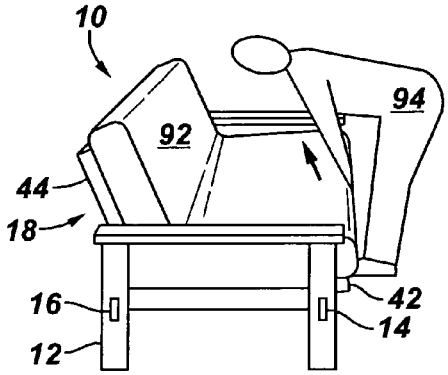
FIGS. 8A through 8D schematically show the steps of converting the cradle from a sofa position to a bed position.
Figure 8B:
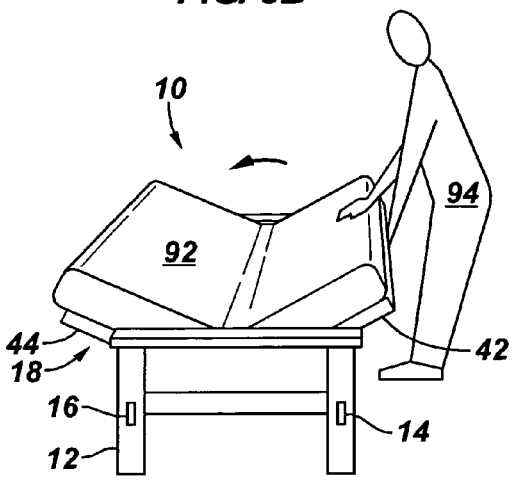
Figure 8C:
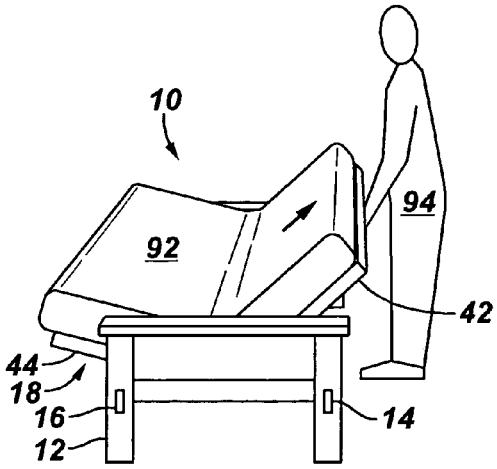

In FIG. 8A, cradle 18 is in a first sofa position, as also illustrated in FIG. 1, with a mattress 92 carried by cradle 18. An operator 94, lifts first deck 42, serving as the seating deck, up from stretcher rail 14. As operator 94 lifts first deck 42, cradle 18 rotates in relation to frame 12 as shown by the arrow in FIG. 8B. In FIG. 8C, cradle 18 has been rotated so that second deck 44 rests on second stretcher rail 16. This position is also illustrated in FIG. 6. From this position operator 94 may pull first deck 42 outwardly from second deck 44 thus disengaging feet 66 from first deck 42 and cradle 18 is in the unlocked position. Operator 94 may then lower first deck down to the bed position, wherein first deck 42 rests on first stretcher rail 14 and cradle 18 is positioned substantially parallel to the ground 30, as shown in FIG. 8D.

Figure 8D:
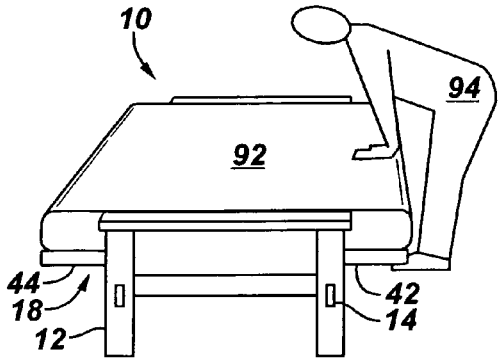
Figure 9A:
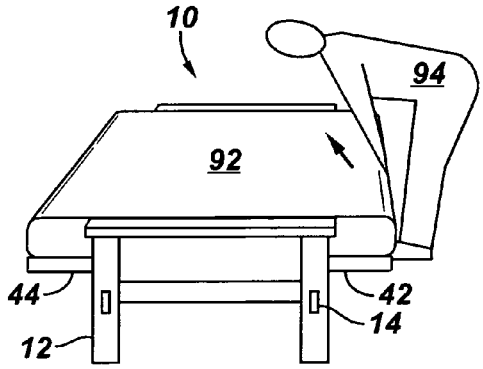
FIGS. 9A through 9D schematically show the steps of converting the cradle from the bed position to a sofa position.
Figure 9B:
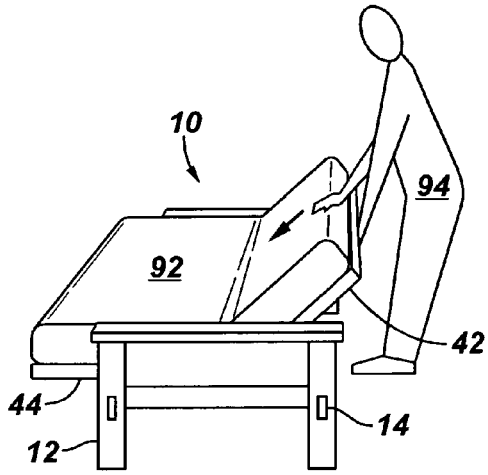
Figure 9C:
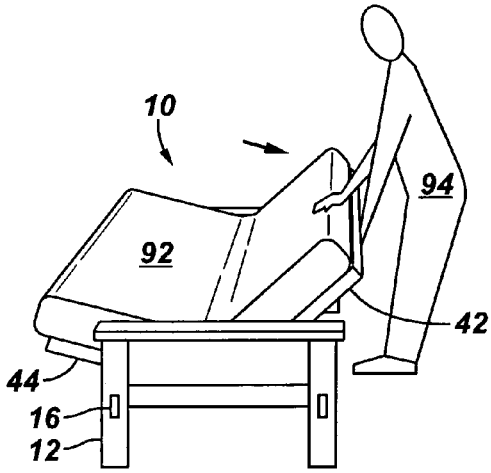
Figure 9D:
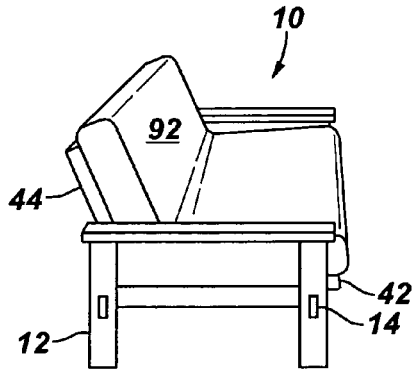

In FIG. 9A, the cradle 18 and mattress 92 are shown in the bed position, as shown in FIG. 8D. Operator 94 may first deck 42 and mattress 92 up from stretcher rail 14 toward back deck 44 as shown in FIG. 9B. Feet 66 will engage first deck 42 and cradle 18 will be in the locked position as shown in FIG. 6. Operator 94 may then push first deck 42 down toward first stretcher rail 14, as shown in FIG. 9C, maintaining the cradle seating angle in a set position into the sofa position as shown in FIG. 9D.

From the foregoing detailed description of specific embodiments of the invention, it should be apparent that a convertible cradle system that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A cradle conversion system for converting a cradle between positions, the system comprising;

a frame having a vertical guide and a horizontal guide;

a first deck having a first and a second arm, each arm forming an elongated slot proximate to an internal end thereof, the elongated slots each having a locked position and an unlocked position;

a second deck having a first extension and a second extension, each extension having an internal end;

a vertical guide projection functionally connected between the second deck and the vertical guide;

a horizontal guide projection functionally connected between the second deck and the horizontal guide;

a first pivotal member connecting the first arm with the first extension, and a second pivotal member connecting the second and with the second extension, wherein the first pivotal member is disposed within the elongated slot of the first extension and the second pivotal member is disposed within the elongated slot of the second extension, each of the pivotal members being moveable between the locked and unlocked positions of the elongated slots; and a first foot member connected to the first extension and a second foot member connected to the second extension, each foot member including a cradle surface substantially parallel to an outer surface and a toe section extending from the cradle surface at an angle toward the outer surface and terminating at a toe end;

wherein when the pivotal members are in the locked position, the toe end of the first foot member engages the first arm and the toe end of the second foot member engages the second arm locking the first and second decks in a set angular relationship to one another.

2. The system of claim 1, wherein the set angular position is less than about 180 degrees.

3. The system of claim 2, wherein when the foot members are engaging the arms, the first and second decks may be moved in relation to the frame and the set angular position will remain substantially the same.

4. The system of claim 1, wherein the foot members are constructed of a substantially rigid material.

5. The system of claim 1, wherein each foot member further includes a support disposed about its toe end.

6. The system of claim 5, wherein the support includes an elongated section extending along a portion of the outer surface of the foot member.

7. The system of claim 1, wherein the pivotal member comprises a bolt.

8. The system of claim 1, wherein the pivotal member includes a roller moveably disposed on a bolt, wherein the roller is disposed within the elongated slot.

* * * * *